US005261865A

United States Patent [19]

Trainor

[11] Patent Number: 5,261,865

[45] Date of Patent: Nov. 16, 1993

[54] BACK STRENGTHENING DEVICE AND METHOD

[75] Inventor: Edward Trainor, Brentwood, N.Y.

[73] Assignee: Backsmart Inc., Brentwood, N.Y.

[21] Appl. No.: 896,075

[22] Filed: Jun. 2, 1992

[51] Int. Cl.[5] ..... A63B 21/068

[52] U.S. Cl. ..... 482/95; 482/124; 482/904

[58] Field of Search ..... 482/94, 95, 96, 93, 482/92, 122, 121, 123, 124, 125, 129, 130, 91, 904

[56] References Cited

U.S. PATENT DOCUMENTS

| | | | |
|---|---|---|---|
| 427,314 | 5/1890 | Hanson et al. | 254/399 |
| 1,144,085 | 6/1915 | Abplanalp . | |
| 2,183,265 | 12/1939 | Maloney | 272/79 |
| 2,938,695 | 5/1960 | Ciampa | 482/904 |
| 3,117,782 | 1/1964 | Johnston | 272/81 |
| 3,714,838 | 2/1973 | Gilson | 74/230.24 |
| 3,966,204 | 6/1976 | Dubach | 482/93 |
| 4,084,815 | 4/1978 | Flannery | 272/119 |
| 4,489,936 | 12/1984 | Dal Monte | 272/120 |
| 4,509,745 | 4/1985 | Angsten | 272/130 |
| 4,574,789 | 3/1986 | Forster | 129/75 |
| 4,685,671 | 8/1987 | Hagerman | 482/124 |
| 5,067,709 | 11/1991 | Christianson | 272/121 |

FOREIGN PATENT DOCUMENTS

| | | | |
|---|---|---|---|
| 732485 | 9/1932 | France | 254/398 |
| 407833 | 9/1968 | Switzerland | 272/121 |

OTHER PUBLICATIONS

Resource Manual for Guidelines for Exercise Testing and Prescription, American College of Sports Medicine, Robert J. Moffat.

*Primary Examiner*—Stephen R. Crow
*Attorney, Agent, or Firm*—Pennie & Edmonds

[57] ABSTRACT

An apparatus, kit and method for stretching and strengthening the muscles of the lower back and legs of a person. The apparatus includes a backboard and a belt to restrain the person's pelvis. A single cable is provided with sliding handles, a pulley guiding system, and leg supporting slings. In a stretching exercise segment, the handles are slowly pulled by the person to raise the legs and thereby stretch the supporting muscles of the spine. In a strengthening exercise segment, the person's feet are pushed toward the floor against the resistance provided by the muscles of the arms.

14 Claims, 6 Drawing Sheets

BACK STRENGTHENING DEVICE AND METHOD

BACKGROUND OF THE INVENTION

This invention relates to an improved method and apparatus for unassisted stretching, exercising and strengthening of the muscles of the lower back and legs, and more particularly to a method and portable apparatus which may be easily employed by users of all abilities, heights and varying body lengths between hips and shoulders for unassisted proprioceptive neuromuscular facilitation (PNF).

PNF is a common stretching technique. A method for stretching hamstring and lower back muscles and strengthening such muscles using PNF is described in *The Goodbye Back Pain Handbook* by James A. Peterson et al. (Masters Press, 5025 28th St., S.E., Grand Rapids, Mich. 49506). In the disclosed technique, the patient lies on a padded board and is restrained around the waist with a strap to stabilize the pelvis. A second person then places one foot on the board and lifts the patient's legs by the ankles upwardly toward the head in a repetitive manner to stretch the lower back and hamstring muscles. The same muscles are strengthened by having the assistant provide controlled resistance to downward movement of the legs.

While the above exercises and method have been proven effective, the method requires the use of an assistant or so-called training partner, preferably who has experience or training with the system. The requirement of an assistant limits the practical usage and availability of the method. U.S. Pat. No. 5,067,709 to Christianson discloses an apparatus for exercising and strengthening the muscles of the lower back which is intended to allow an individual to utilize the above described stretching technique without an assistant. The Christianson device comprises two components, a pelvis board with a strap for retaining the pelvis and a rope and pulley system for raising the legs. The rope and pulley system is connected between the feet or legs of the user and a support above the head of the user. The pulley system is a "block and tackle" type arrangement that allows the user a mechanical advantage in raising the legs. One of the pulleys also includes a clutch device to provide resistance when the legs are lowered. In the Christianson device, both of the user's feet or legs are held together in a supporting sling. The free end of the rope is grasped by the user. By pulling or releasing the rope, the user is able to pull the legs upwardly toward the head, and to gradually lower the legs toward the floor with resistance against the clutch device.

While providing for unassisted exercise, the Christianson device has a number of drawbacks. For example, the user must directly grip the rope, which can be difficult or fatiguing to the hands. To reduce this problem, Christianson has employed the relatively complex pulley system. Also, the arrangement of the rope and sling allows only both legs to be raised together, which may be undesirable or impossible for some users. In order to use the device with one leg at a time, the user would have to stop exercising and switch the sling from one leg to another.

A number of other exercise devices are known in the art and that exhibit similar disadvantages to Christianson. One example is the apparatus described in U.S. Pat. No. 3,117,782 to Johnston. The Johnston patent discloses an exercise apparatus which includes a back supporting mat and a cable and pulley system. The Johnston cable terminates at each end with a handle and forms a single harness in the middle that secures both legs together at the ankles. The user of the Johnston device lies down, inserts both feet into the harness, reaches up to grab a respective handle and raises or lowers both legs by swinging his arms in an arc between a position parallel to the floor and a position well back of the head. The Johnston apparatus is thus also limited to use with both feet together without stopping and removing the harness.

Other devices exhibiting one or more of the above drawbacks are disclosed in U.S. Pat. Nos. 1,144,085, 4,084,815 and Swiss patent No. 407833.

While the above described devices may be effective in the case of certain users, they do not satisfactorily account for the needs of all potential users of varying ability who are lower pack pain sufferers and wish to progress gradually in their muscle stretching and strengthening exercises.

SUMMARY OF THE INVENTION

It is therefore an object of the present invention to provide an unassisted back exercise apparatus that alternately allows for single or dual leg use and also allows for alternating single leg use, without removing or readjusting the device. This is accomplished according to the present invention by a unique arrangement of a single rope and pulleys.

It is a further object of the invention to provide an apparatus and method for unassisted back exercise which utilizes particular muscles to provide efficient exercise for users of all abilities.

These and other objects may be realized according to the present invention by an apparatus which comprises a back support having means for restraining and immobilizing the pelvis of a person while allowing upward tilting of the legs, a flexible element having first and second ends, a pair of handles slidably mounted on the flexible element between its first and second ends, a first leg or foot stirrup connected to the first end of the flexible element, a second leg or foot stirrup connected to the second end of the flexible cable means, and means for guiding and supporting the flexible element.

The flexible element comprises a wire cable or other suitable means which is manipulated by the user via the handles in order to lift the legs. The cable guiding and supporting means are preferably a pair of pulleys equipped with suitable attachment means for securing them in a cable supporting position above the user's head. In a preferred embodiment, the pulley depends from an extensible post pivotally secured to the back support. In an alternate embodiment, the pulley is secured to a door knob or any suitable ceiling-mounted or wall-mounted structure.

The single cable and sliding handle system of the present invention permits the user to raise and lower one or both legs and to exercise various muscle groups in accordance with the user's abilities.

DETAILED DESCRIPTION OF THE PREFERRED EMBODIMENTS

Figure 1:
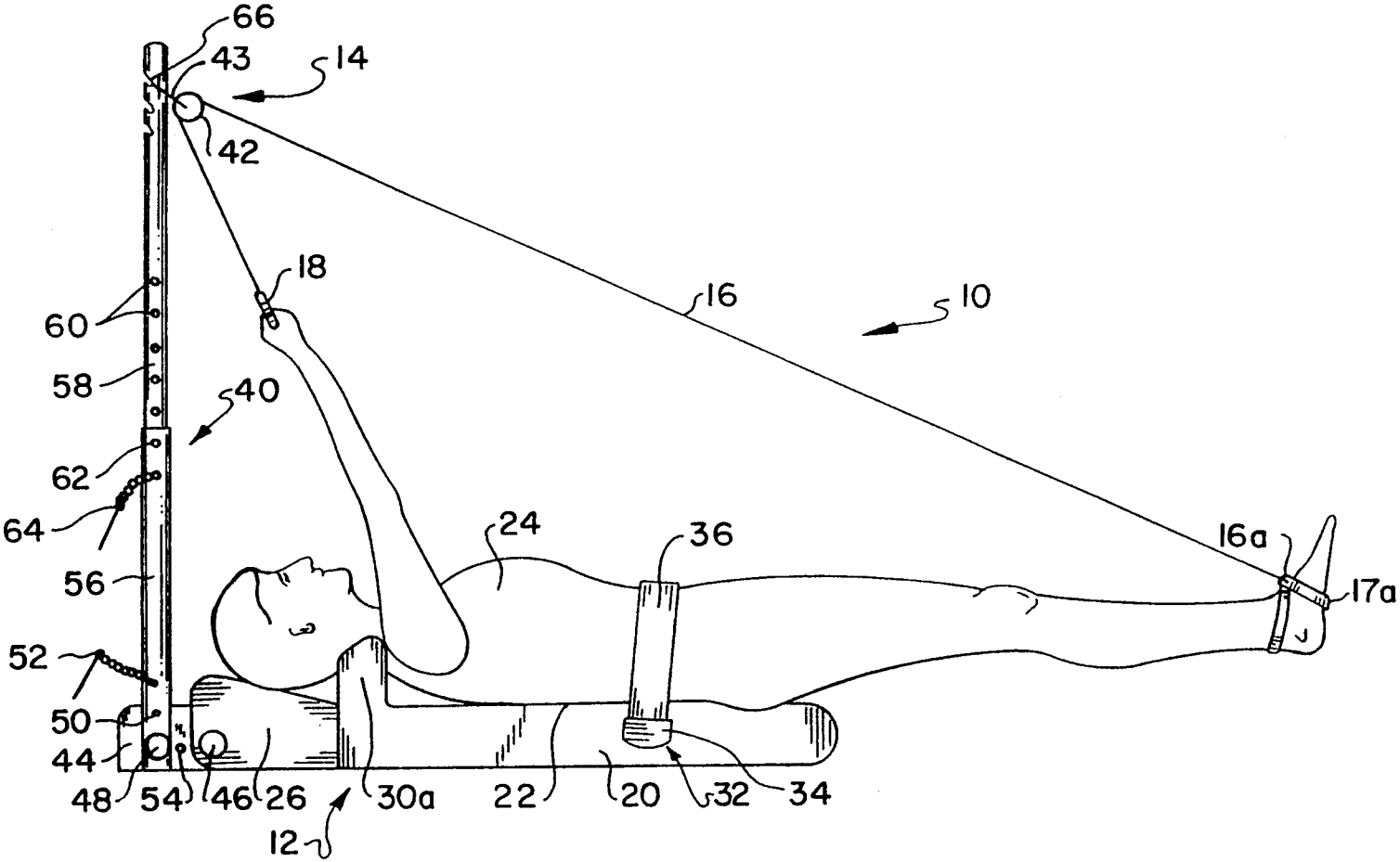
FIG. 1 is a side view of an embodiment of the present invention showing the user in an initial or starting position.
Figure 2:
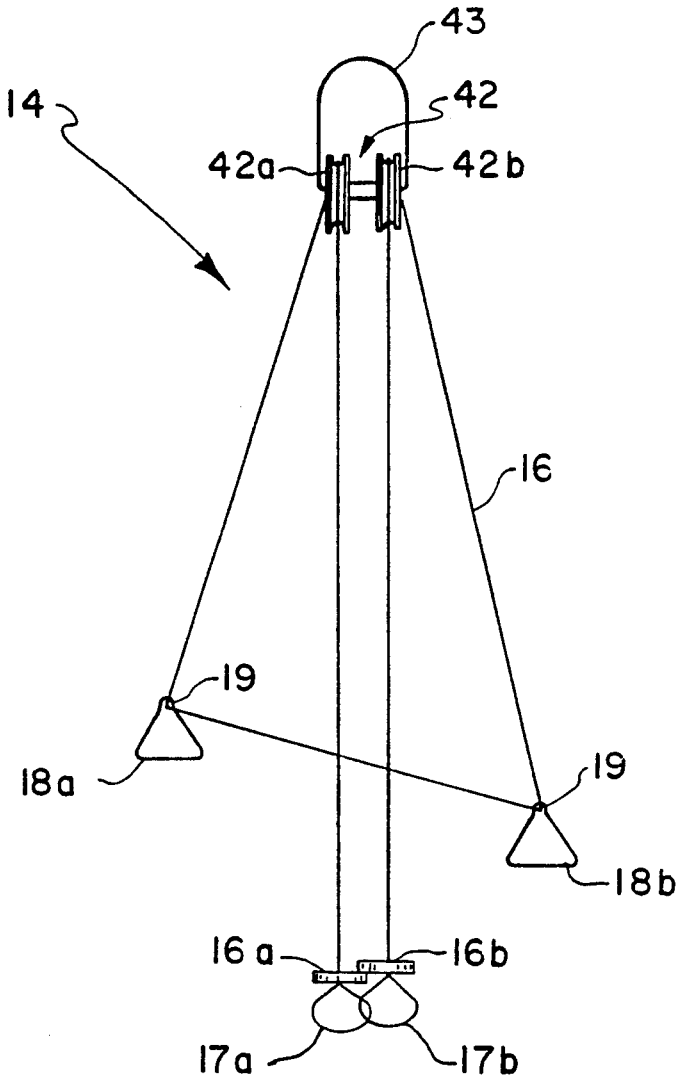
FIG. 2 is a partial plan view depicting the flexible element and pulley system and the associated handles and stirrups.
Figure 3:
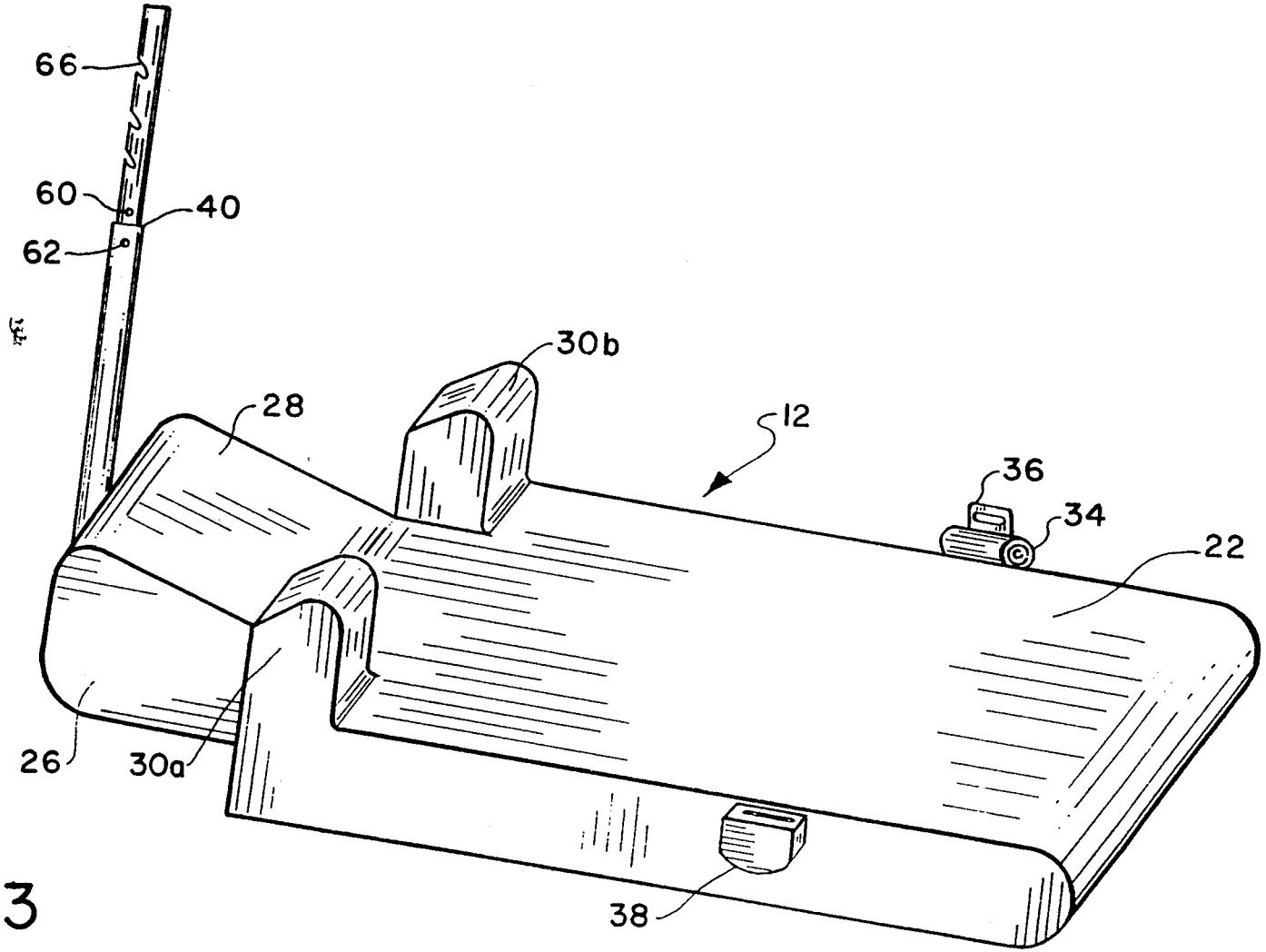
FIG. 3 is a perspective view depicting the support and the associated pelvis restraining strap, without the cable and pulley system in place.

With particular reference to FIGS. 1-3 of the drawings, a preferred embodiment of the present invention will be described. As shown in FIG. 1, device 10 includes two general components. The first component comprises means 12 for supporting the back while also restraining and immobilizing the pelvis of the user in a fixed position relative to the other elements of the device. The second component comprises a flexible element system 14 operable by the user to lift one or both legs by alternately pulling and releasing flexible element 16 with handles 18.

The back supporting component is generally referred to by the reference numeral 12 and comprises a cushioned backboard 20 having a substantially planar upper surface 22 for supporting the user's back and pelvis. Upper surface 22 should be dimensioned to accommodate torso sizes of various users. The purpose of backboard 20 is to stably position and restrain the pelvis of the user relative to the flexible element system to be described herein. The backboard is supported upon any planar surface and has a length which is greater than the upper torso and head of the user 24 as shown.

At one end, the backboard preferably includes headrest 26. The upper surface 28 of the head rest is preferably inclined in order to slightly elevate the head and thereby minimize spinal strain in the user's neck and tend to align the spine in a straight position. The backboard may also include a pair of spaced shoulder supports or restraints 30*a* and 30*b* which prevent the user from sliding during exercise and assist the user in maintaining a proper orientation on the backboard during use.

Preferably, backboard 20 also includes a retractable locking belt assembly 32 which is positioned proximate to the end of the backboard which is opposite the head rest. Retractable belt assembly 32 may be of conventional design, similar to known seat belts, and includes a belt retention and winding element 34 positioned on one side of the backboard 20, a belt 36 having a first end connected thereto, and a belt locking element 38 located on an opposite side of the backboard and releasably securing a second end of the belt. Belt 36 is used to encircle the user's waist and hold the pelvis against the surface 22. It should be understood that other known waist securing and immobilizing means may be employed. For example, the backboard 20 may be provided with apertures or slots adjacent the longitudinal edges thereof for securement of adjustable straps or the like.

Back supporting component 12 of the preferred embodiment also includes a height-adjustable vertical post 40 that provides a mounting location for cable guiding and supporting means 42, described below. The lower end of vertical post 40 may be secured to the backboard by direct pivotal attachment. Preferably, however, an intermediate member 44 which extends horizontally from behind the head rest 26 is provided for this purpose. The intermediate member 44 is pivotally attached at one end to the head rest by pivot pin 46. The opposite or extending end of intermediate member 44 is pivotally connected to the lower end of the post 40 by pivot pin 48. The extending end of intermediate member 44 is provided with a first aperture (not shown). The bottom end of post 40 is also provided with an aperture 50. In order to lock post 40 in a substantially vertical orientation, the respective apertures are axially aligned and a removable locking pin 52 is inserted. When the device is not in use, the post may be folded into a position underneath the backboard 20. The intermediate member may also be provided with a second aperture 54 so that post 40 can be folded to align aperture 50 therewith and locking pin 52 can be inserted therethrough. The bottom of the backboard 20 may also be provided with a longitudinal recess to receive the folded post in a compact manner for increased portability.

Preferably, post 40 consists of two telescoping sections, lower post section 56 and upper post section 58. Upper post section 58 includes a plurality of linearly spaced apertures 60, and lower post section 56 includes a similar aperture 62 proximate its upper end. The user determines the preferred height of post 40 by selecting one of the apertures 60 on the upper section and aligning it with aperture 62. Locking pin 64 is then inserted to maintain the desired length. Locking pins 52 and 64 are secured by lanyards to prevent loss. It is understood that other conventional locking devices familiar to those of ordinary skill in the art may also be utilized to secure the post sections.

The upper section 58 is preferably provided with three angled slots 66 to which the flexible element system is secured. It is contemplated that other mounting provisions may be made on the post for securing the flexible element system.

With particular reference to FIGS. 1 and 2, the flexible element system 16 of the present invention will now be described.

As shown in FIG. 2, system 14 comprises wire cable or rope 16 having first and second ends 16*a*, 16*b*. Preferably the cable is about ten feet in length. First end 16*a* is secured to first stirrup 17*a*. Cable 16 extends over first cable guiding means 42*a*, through first and second holding means 18*a* and 18*b*, respectively, and back over second cable guiding means 42*b*. Second cable end 16*b* is secured to second stirrup 17*b*. An adjustable length attachment for cable 16 may be provided at one or both of ends 16*a* or 16*b*. This is easily accomplished by providing a snap-type fitting on one stirrup and a number of spaced loops at the end of the cable. Adjustment of the length allows the invention to be easily adapted to users of different size.

Stirrups 17*a* and 17*b* may be provided in any form suitable to separately and comfortably engage the legs or feet. Preferably each stirrup includes a loop that extends around the arch of the foot and a strap that extends around the heal to prevent slippage as shown in the figures.

In a preferred embodiment, cable guiding means 42 comprise a pair of coaxial pulleys 42*a* and 42*b*. However, it is contemplated that non-rotating, grooved members comprised of low friction material might also be used in lieu of rotating pulleys. The pulleys 42*a* and 42*b* have suitable securing means 43 attached thereto for suspending them from slots 66 in post 40, or other support as described below. Securing means 43 may be a loop of cable or wire attached to the ends of the pulley axle, as shown in FIG. 1.

Figure 4:
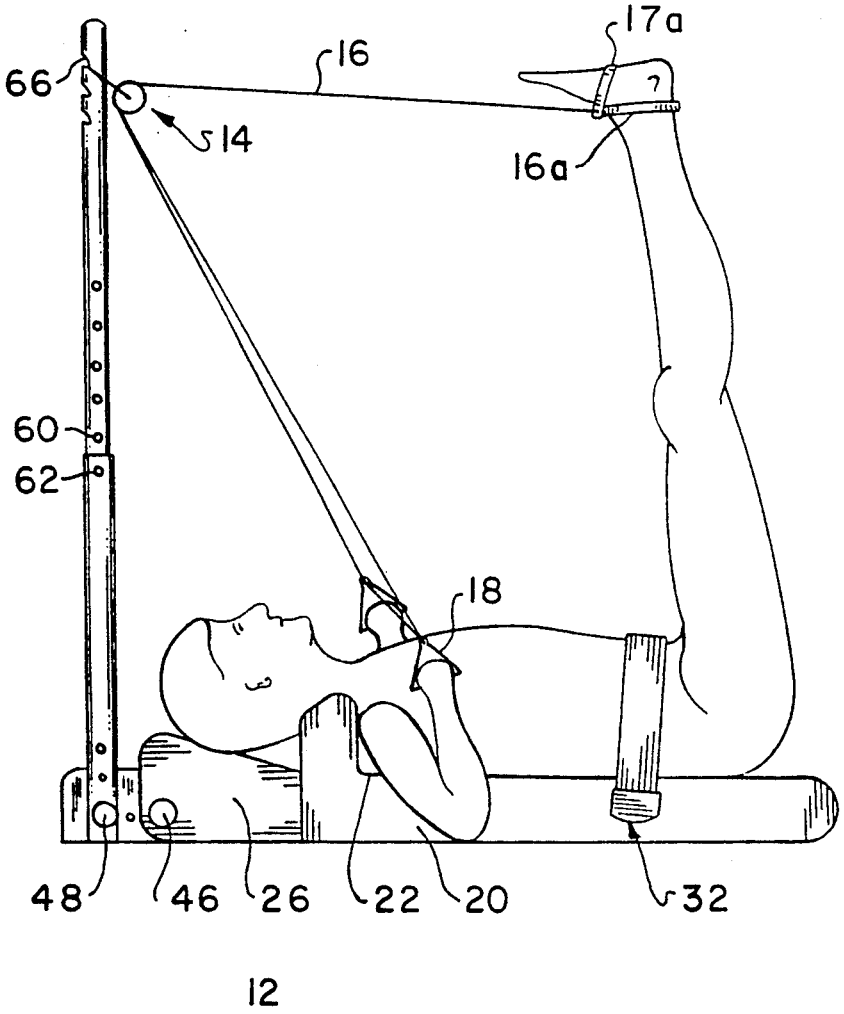
FIG. 4 is a side view of the exercise device showing a user with both legs raised and a corresponding handle position.
Figure 5:
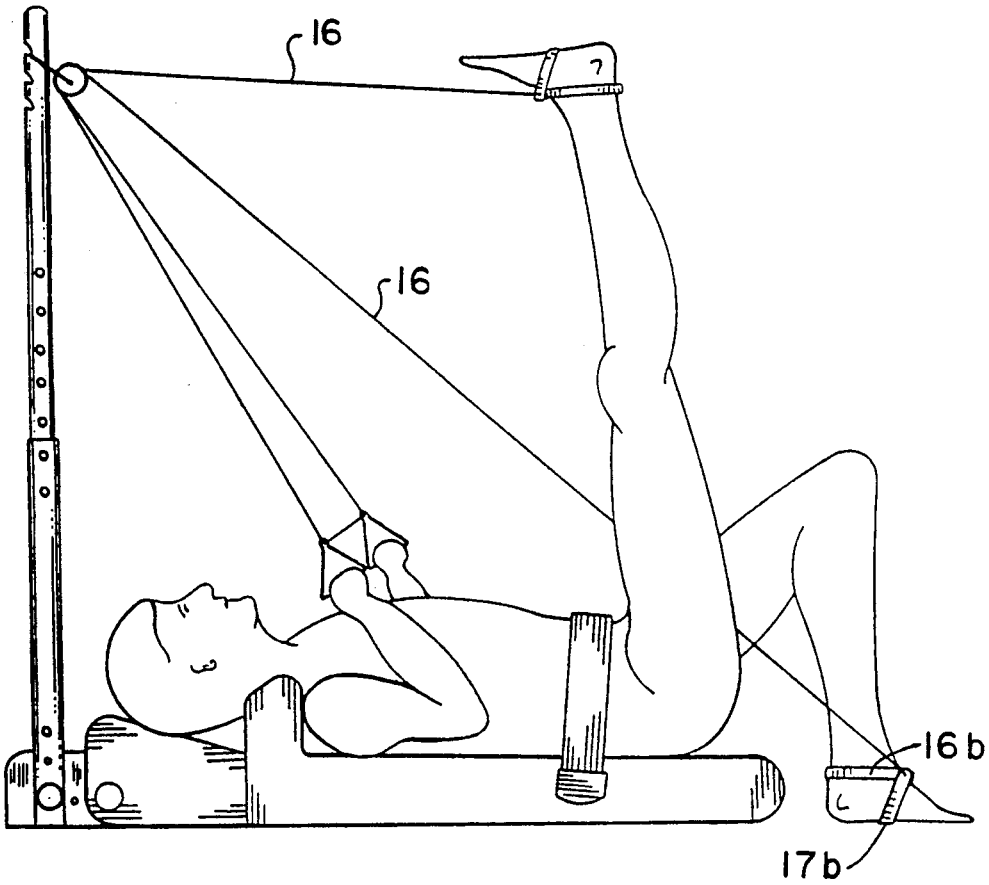
FIG. 5 is a side view of the exercise device showing a user with only one leg raised and a corresponding handle position.

Holding means or handles 18*a* and 18*b*, shown in FIG. 2, each include means 19 for slidably receiving the cable. Means 19 may take a variety of forms, for example, the detent configuration shown in FIG. 2 or a separate ring secured to each handle and slidably receiving the cable (not shown). Each handle is thus slidably mounted on the cable. The inclusion of the slidably mounted handles on a single flexible element permits the user to perform single or dual leg exercises as shown in FIGS. 4 and 5 without removing the legs and feet from stirrups 14.

Figure 6:
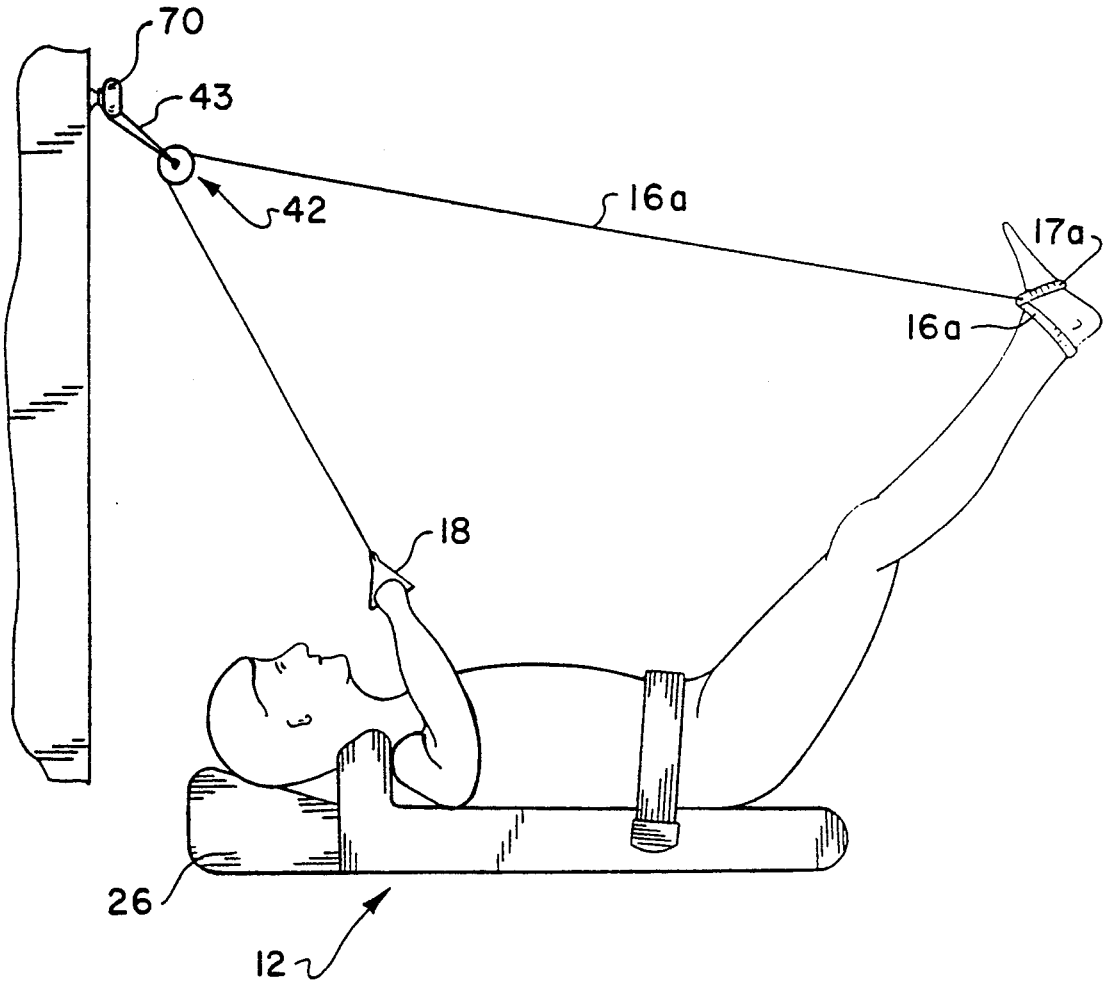
FIG. 6 is a side view of an alternative embodiment of the present invention and showing the user's legs raised to an intermediate position.

With particular reference to FIG. 6, an alternate embodiment of the present invention will also be described. As shown in FIG. 6, the exercise device is substantially the same as the arrangement shown in FIG. 1. However, in this embodiment vertical post 40 and associated structure is omitted and the cable guide system is instead suspended by appropriate means to a door knob 70 or other conveniently located wall or ceiling mounted structure. For example, a flexible member that can be closed in the door may provide an adjustable height support.

The present invention has been described above as a single unit. It is also contemplated that the invention may be provided in kit form, with the various components as described above assembled by the user.

With reference to FIGS. 1, 6, 4 and 5, the technique for using the invention will be explained. The technique for use is the same whether the embodiment of the invention shown in FIGS. 1 or 6 is employed. In fact, the technique is illustrated with FIG. 1 showing an initial step and FIG. 6 showing an intermediate step in the same procedure. Once the apparatus has been assembled as shown in FIGS. 1 or 6, the user places each foot in one of stirrups 17*a* or 17*b*, and then reaches up and grasps the respective handles firmly as shown in FIG. 1. An alternative starting position may be used with both feet drawn up to the pelvis and the knees bent. The handles are then pulled toward the chest and the legs raised to the position shown in FIG. 6. Beginning the stretching portion of the exercise, the user slowly extends the arms away from the body while keeping the legs unbent and lifting them slightly past vertical, until reaching the position shown in FIG. 4. Depending on the individual user's flexibility, the legs may be moved further past vertical, up to the point of touching pulleys 42*a* and 42*b*.

In the position illustrated in FIG. 4, the upper body of the user should form a "T" with the arms extended outwardly, while the lower body forms an "L". For maximum benefit, this position should be maintained for at least approximately 8 seconds. Thereafter, the strengthening portion may be performed by pushing the heels down and toward the floor while using the arms as resistance against the lower back extensors. For maximum benefit, it has been found that the legs should be pushed down to about a 45 degree angle, approximately as shown in FIG. 6. Repetitions of the above exercise typically will begin with a single set of about four and be increased gradually until a set of about eight or more is comfortable.

By utilizing the pulling motion and extension to the "T" shape as described above, the user employs the lateral and tricep muscle groups in raising, and then resisting, the legs. The triceps are among the strongest muscles in the body. The technique therefore may be readily performed by persons of all abilities without undue muscle strain and/or injury.

For users with lower initial flexibility, a modified exercise is possible—without any equipment modification—as shown in FIG. 5. In this exercise, one leg remains on the floor while the other is raised. The handles are pulled toward the chest, but the arms are not extended to form the "T" shape. The single cable means with freely sliding handles allows the device to self-adjust and thus easily accommodate the foot which remains on the floor. The user may perform a number of repetitions with the same leg or may alternate between legs without removing stirrups 17*a* or 17*b* from either foot. The exact hand and leg position will vary somewhat depending on the user's size and the cable length employed.

Exercise with the described apparatus and technique will relax muscle tissue and increase flexibility. The strengthening portion of the exercises results in an increased level of strength in the exercised muscle groups. The resulting stronger back muscles are less susceptible to injury and assist the user in sustaining proper body alignment.

What is claimed is:

1. An apparatus for stretching and strengthening the lower back of a user and raising and lowering the user's legs, comprising:

an elongated flexible element having first and second ends adapted to be separately secured to the legs or feet of the user;

holding means for securing the hands of the user, said holding means slideably mounted on said flexible element between the first and second ends such that said means slides along said element in response to force applied by the user to raise the user's legs; and means for guiding and supporting said flexible element, whereby the user may alternately raise one or both legs by pulling said holding means toward the user without unsecuring the first or second ends of said flexible element from the user's legs.

2. The apparatus of claim 1 wherein said holding means comprises at least one member adapted to be gripped by the user's hand, said member including means for receiving said flexible element for sliding movement with respect to said member.

3. The apparatus of claim 1, wherein said guiding means comprises first and second pulleys.

4. The apparatus of claim 1, further comprising means for restraining the pelvis of the user while allowing upward lifting of the legs with the flexible element.

5. The apparatus of claim 4 wherein said pelvis restraining means comprises:

a backboard having substantially flat surface for supporting the user's back and pelvis;

means for securing the user's pelvis to said backboard; and spaced apart members extending outwardly from said flat surface and configured and dimensioned to separately engage the user's shoulders to prevent sliding motion of the user along said surface during lifting of the legs.

6. The apparatus of claim 4, wherein said guiding means comprises first and second pulleys mounted coaxially on a common shaft and said supporting means comprises a rigid member mounted on said restraining means and extending upwardly therefrom, said shaft being secured to the rigid member opposite the restraining means.

7. The apparatus of claim 1, wherein said guiding means comprises first and second pulleys mounted coaxially on a common shaft and said supporting means comprises a second flexible element secured to the shaft and adapted to be attached to a support structure.

8. An apparatus for unassisted strengthening and stretching of the lower back muscles of a human user wherein the user lies on his or her back, said apparatus comprising:

an elongated flexible element having first and second ends, each end having means for separately securing the end to one of the user's feet;

means for guiding and supporting the flexible element above the user, wherein the flexible element twice passes over said guiding and supporting means with said first and second ends disposed to one side of the guiding and supporting means and the flexible element forming a loop portion disposed to the opposite side of the guiding and supporting means; and holding means for securing the hands of the user, comprising first and second members slideably disposed on the flexible element in said loop portion, such that the user may alternately raise both legs or either single leg, without unsecuring the first or second end of the flexible element from the user's legs, by forcing said first and second members to different predetermined positions dependent on whether a single leg or both legs are raised.

9. The apparatus of claim 8, further comprising a substantially flat member for supporting the user's back and pelvis and two spaced apart projections extending outwardly from said flat member, configured and dimensioned to engage the shoulders of the user and thereby prevent sliding of the user during stretching and strengthening.

10. The apparatus of claim 9, wherein said guiding and supporting means is secured to the substantially flat member by a rigid member mounted on the flat member.

11. A kit for assembly into an apparatus for unassisted strengthening and stretching of a human user'lower back, said kit comprising in combination:

an elongated flexible element having first and second ends;

first and second means for separately securing each of said first and second ends, respectively, to one of the user's feet or legs, said first means adapted to be secured to said first end and said second means adapted to be secured to said second end;

first and second handle members each including means configured and dimensioned for slidingly receiving the flexible element between the first and second ends;

first and second guide surfaces configured and dimensioned to receive two portions of the flexible element in side-by-side relationship;

a pelvis restraining member configured and dimensioned to allow the user to lie thereon with the back and pelvis substantially flat thereagainst; and means for supporting the guide surfaces above the pelvis restraining member.

12. The kit of claim 11, wherein the guide surfaces comprise two pulleys mounted coaxially on a common shaft.

13. The kit of claim 11, wherein said support means comprise a second flexible element secured to the guide surfaces and adapted to be mounted on a door or wall.

14. The kit of claim 11, wherein said support means comprises a rigid structure configured and dimensioned to be mounted on the pelvis restraining member with the guide surfaces mounted on said rigid structure.

* * * * *